US010927853B2

(12) United States Patent
Goeders et al.

(10) Patent No.: US 10,927,853 B2
(45) Date of Patent: Feb. 23, 2021

(54) SURFACE FOR DIRECTIONAL FLUID TRANSPORT INCLUDING AGAINST EXTERNAL PRESSURE

(71) Applicant: KIMBERLY-CLARK WORLDWIDE, INC., Neenah, WI (US)

(72) Inventors: Karen M. Goeders, Alpharetta, GA (US); Marsha R. Forthofer, Woodstock, GA (US); Wing-Chak Ng, Roswell, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/496,979

(22) PCT Filed: Mar. 22, 2018

(86) PCT No.: PCT/US2018/023715

§ 371 (c)(1),
(2) Date: Sep. 24, 2019

(87) PCT Pub. No.: WO2018/183074

PCT Pub. Date: Oct. 4, 2018

(65) Prior Publication Data

US 2020/0096009 A1 Mar. 26, 2020

Related U.S. Application Data

(60) Provisional application No. 62/478,191, filed on Mar. 29, 2017.

(51) Int. Cl.
*F04F 7/00* (2006.01)
*F04B 19/00* (2006.01)

(52) U.S. Cl.
CPC ..... *F04F 7/00* (2013.01); *F04B 19/00* (2013.01)

(58) Field of Classification Search
CPC ..... F04F 7/00; F04B 19/00
(Continued)

(56) References Cited

U.S. PATENT DOCUMENTS 4,685,914 A 8/1987 Holtman
4,685,915 A 8/1987 Hasse et al.
(Continued)

FOREIGN PATENT DOCUMENTS

CA 2875722 A1 12/2014
JP 2001035980 A 2/2001
(Continued)

OTHER PUBLICATIONS

Philipp Comanns, Kai Winands, Mario Pothen, Raya A. Bott, Hermann Wagner, Werner Baumgartner, "The Texas horned lizard as model for robust capillary structures for passive directional transport of cooling lubricants,"Proc. SPIE 9797, Bioinspiration, Biomimetics, and Bioreplication 2016, 979711. (Year: 2016).*
(Continued)

*Primary Examiner* — Christine T Mui
(74) *Attorney, Agent, or Firm* — Kimberly-Clark Worldwide, Inc.

(57) ABSTRACT

A capillary structure for passive, directional fluid transport, includes a capillary having a forward direction and a backward direction extending in an x-y plane and a depth extending in a z-direction, the capillary including first and second capillary units each having a diverging section having a backward end, a forward end, and a width in the y-direction, wherein the width increases from the backward end to the forward end, wherein the backward end of the second capillary unit diverging section is connected to the forward end of the first capillary unit diverging section to form a transition section having a step decrease in width from the forward end of the first capillary unit diverging
(Continued)

section to the backward end of the second capillary unit diverging section, and wherein the depth in the transition section is less than the depth in each diverging section.

20 Claims, 9 Drawing Sheets

(58) Field of Classification Search
USPC ..... 422/502, 500
See application file for complete search history.

(56) References Cited

U.S. PATENT DOCUMENTS

| | | | |
|---|---|---|---|
| 4,798,603 | A | 1/1989 | Meyer et al. |
| 4,960,477 | A | 10/1990 | Mesek |
| 5,200,248 | A | 4/1993 | Thompson et al. |
| 5,281,208 | A | 1/1994 | Thompson et al. |
| 5,855,572 | A | 1/1999 | Schmidt |
| 5,972,505 | A | 10/1999 | Phillips et al. |
| 6,103,953 | A | 8/2000 | Cree et al. |
| 6,372,954 | B1 | 4/2002 | Johnston et al. |
| 7,205,259 | B2 | 4/2007 | Soerens |
| 7,781,639 | B2 | 8/2010 | Johnston et al. |
| 8,197,775 | B2 | 6/2012 | Johnston et al. |
| 2007/0006926 | A1* | 1/2007 | Prakash ..... F15C 1/02 137/800 |
| 2009/0217981 | A1 | 9/2009 | Extrand et al. |
| 2012/0082599 | A1 | 4/2012 | Weber |
| 2016/0167043 | A1 | 6/2016 | Comanns |
| 2016/0361206 | A1 | 12/2016 | Engelhardt |

FOREIGN PATENT DOCUMENTS

| | | | | |
|---|---|---|---|---|
| KR | 101348655 | B1 | 1/2014 | |
| WO | WO 2014/000735 | * | 1/2014 | ..... B01L 2400/0406 |

OTHER PUBLICATIONS

Berthier et al., "Spontaneous capillary flows in piecewise varying cross section microchannels," Sensors and Actuators B: Chemical, Feb. 2016, vol. 223, pp. 868-877.

Erickson et al., "Numerical Simulations of Capillary-Driven Flows in Nonuniform Cross-Sectional Capillaries." Journal of Colloid and Interface Science. Jun. 2002, pp. 422-430.

* cited by examiner

SURFACE FOR DIRECTIONAL FLUID TRANSPORT INCLUDING AGAINST EXTERNAL PRESSURE

BACKGROUND

Typically, large masses of materials are required to move fluid volumes due to the random orientation of fibers in many porous structures found in absorbent and fluid handling structures. As a result, several materials with different properties are used in combination to transport fluid. A surface that could enhance movement of fluid would allow a structure to perform better and to take advantage of capacity that is not typically used. Such a surface can be formed or placed to facilitate liquid movement. In this manner, fluid does not move randomly but instead follows the surface structure even if the surface structure is bent or positioned in another way such that fluid transport against gravity or against another external source of pressure is present. This provides one the ability to manage where fluid travels.

Previous, unsuccessful attempts to address these or related problems include Canadian Patent Application No. CA2875722 A1 to Comanns et al., which describes interconnected capillaries, and the technical publication "One-way Wicking in Open Micro-channels Controlled by Channel Topography," Journal of Colloid and Interface Science 404 (2013) 169-178, which describes a directional fluid transport that attempts to minimize, but does not eliminate, backflow. Patent Application No. US 2016/0167043 to Baumgartner et al. describes a surface for directional fluid transport but does not disclose or teach changes in channel depth or any effects thereof. In addition, Patent Application No. WO 2016/124321 A1 describe directional transport perpendicular to a surface where changes in depth orthogonal to the liquid transport direction are not disclosed or taught. Microfluidic valves such as those described in the technical publication "Valves for Autonomous Capillary Systems," Microfluidics and Nanofluidics 5 (2008) 395-402 are designed to stop or delay liquid flow in one direction; however, they are arranged in such a way that they do not allow flow along the surface. Furthermore, the capillary channels had equal depths and were only able to stop the liquid fronts for several seconds.

SUMMARY

The disclosure described herein solves the problems described above and provides an increase in efficacy in fluid handling.

In accordance with the present disclosure, a capillary structure for passive, directional fluid transport, includes a capillary having a forward direction and a backward direction extending in an x-y plane and a depth extending in a z-direction, the capillary including first and second capillary units each having a diverging section having a backward end, a forward end, and a width in the y-direction, wherein the width increases from the backward end to the forward end, wherein the backward end of the second capillary unit diverging section is connected to the forward end of the first capillary unit diverging section to form a transition section having a step decrease in width from the forward end of the first capillary unit diverging section to the backward end of the second capillary unit diverging section, and wherein the depth in the transition section is less than the depth in each diverging section.

The disclosure also describes a substrate for directional transport of a fluid having a contact angle θ, the substrate including a capillary structure for passive, directional fluid transport, the capillary structure including a plurality of capillaries each having a forward direction and a backward direction extending in an x-y plane and a depth extending in a z-direction, each capillary including first and second capillary units each having a diverging section having a backward end, a forward end, and a width in the y-direction, wherein the width increases from the backward end to the forward end, wherein the backward end of each second capillary unit diverging section is connected to the forward end of the corresponding first capillary unit diverging section to form a transition section having a step decrease in width from the forward end of the first capillary unit diverging section to the backward end of the second capillary unit diverging section, and wherein the depth in the transition section is less than the depth in each diverging section.

The disclosure further describes a capillary structure for passive directional transport of a fluid having a contact angle θ with regard to the capillary structure, the structure including a capillary having a forward direction and a backward direction extending in an x-y plane and a depth extending in a z-direction, the capillary including first and second capillary units each having a diverging section having a backward end, a forward end, and a width in the y-direction, wherein the width increases linearly from the backward end to the forward end, a connective section interposed between the forward end of the first capillary unit diverging section and the backward end of the second capillary unit diverging section, wherein the connective section is in fluid communication with each diverging section, wherein the backward end of each second capillary unit diverging section is connected to the connective section, wherein the forward end of the corresponding first capillary unit diverging section is connected to the connective section to form a transition section having a step decrease in width from the forward end of the first capillary unit diverging section to the connective section, and wherein the depth in the transition section is less than the depth in each diverging section, and wherein the connective section with a width profile w(x) changes depth with an angle profile β(x) and has an aspect ratio $\alpha(x)_{connective}=h(x)/w(x)>(1-\cos(\theta+\beta))/(2\cos\theta)>0$, wherein the diverging section diverges from the connective section at an angle α such that $\alpha<\pi/2-\theta$ and $\alpha<\theta$, and wherein the transition section has a depth less than the depth in the diverging section.

Other features and aspects of the present disclosure are discussed in greater detail below.

BRIEF DESCRIPTION OF THE DRAWINGS

The foregoing and other features and aspects of the present disclosure and the manner of attaining them will become more apparent, and the disclosure itself will be better understood by reference to the following description, appended claims and accompanying drawings, where:

Figure 1:
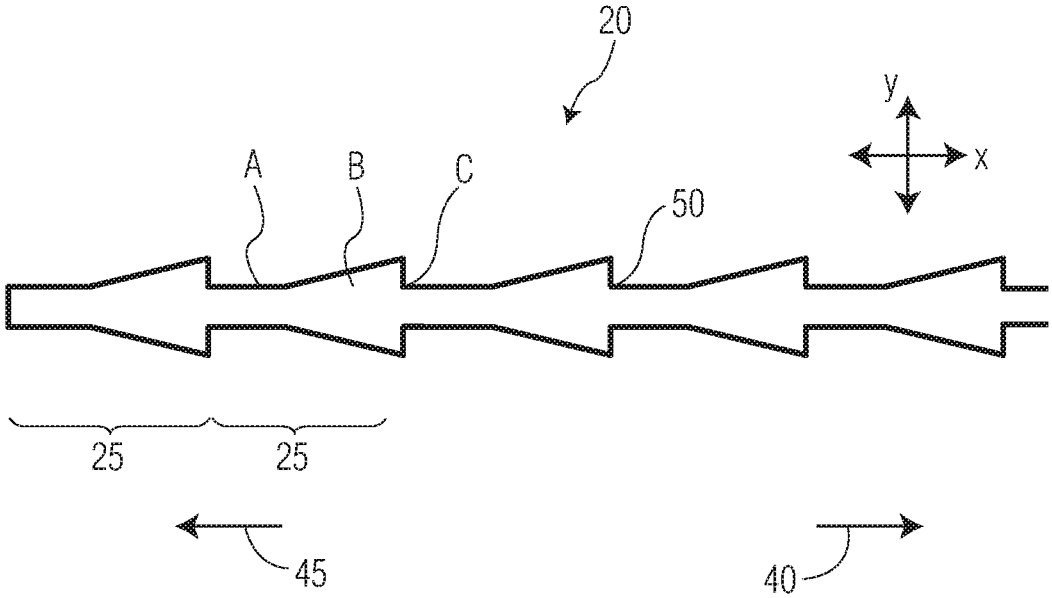
FIG. 1 is a schematic plan illustration of the surface design of a capillary of a liquid diode of the present disclosure.

Repeat use of reference characters in the present specification and drawings is intended to represent the same or analogous features or elements of the present disclosure. The drawings are representational and are not necessarily drawn to scale. Certain proportions thereof might be exaggerated, while others might be minimized.

DETAILED DESCRIPTION

It is to be understood by one of ordinary skill in the art that the present discussion is a description of exemplary aspects of the present disclosure only, and is not intended as limiting the broader aspects of the present disclosure.

The present disclosure is generally directed to applications benefiting from directional fluid transport. In general, the application spectrum of such a directional liquid transport is broad and ranges from absorbent articles to microfluidics, medical applications, distilleries, heat exchangers, electronics cooling, filtration systems, lubrication, e-ink displays, and water harvesting devices.

The present disclosure is directed to a surface for directional fluid transport including complete directional liquid transport by capillary forces. The design allows for directional flow against gravity (or not against gravity) through usage of closed, partially-closed, or open capillaries (i.e., capillaries) to control fluid transport from a source location to a separate desired location.

In one example, large masses of materials are required to move fluid volumes due to the random orientation of fibers in many porous structures. As a result, in one approach several materials with different properties are used in combination to transport fluid. A surface that could enhance movement of fluid, particularly into the more remote parts of a structure even against an external pressure such as that induced by gravitational force, would allow the structure to take advantage of flow area or absorbent capacity that is not typically used. Such a surface, for example, can be formed or placed on a laminate, composite, foil, or film to facilitate liquid movement. In this manner, fluid does not move randomly but instead follows the surface structure. This provides one the ability to design and manage where fluid travels.

In addition, fibrous, porous structures are prone to pore collapse or fouling once wetted, resulting in inefficiencies in liquid transportation. The surface structure of the present disclosure is designed such that the capillaries provide renewable void space by transferring liquid to another location or to a storage material, thus making the channels available again for use. This can be achieved by fabricating the material out of a film, a gel, a film-like structure, or rigid materials including rigid polymer materials.

All liquid-material combinations with a contact angle of $0<\theta<90°$ (inherently or by treatment) are suitable for directional liquid transport according to the present disclosure. Examples of suitable materials include polymers, metals, ceramics, semi-conductors, glasses, films, nonwovens, or any other suitable material. The term polymer is not restricted to technical polymers but incorporates biodegradable polymers such as cellulose compounds, polyphosphazenes, polylactic acids (PLAs), and elastomers such as poly(dimethylsiloxane) (PDMS). Especially suitable for use in the present application are polymers such as poly(methylmethacrylate) (PMMA), PLAs, polypropylene (PP), silicones, epoxy resins, hydrogels, polyamide (PA), polyethylene terephthalate (PET), cellulose acetate (CA), cellulose acetate butyrate (CAB), and off-stoichiometry thiol-ene. Liquid-material combinations that do not have an inherent contact angle of $0<\theta<90°$ can be changed by surface or chemical treatments such as plasma modification, corona discharge, spin coating, spray coating, or by any suitable method or combination of methods. The material can be or can be made hydrophilic or lipophilic.

With respect to the specific surface structure of the present disclosure, the substrate on which the surface structure is formed includes a surface that has a contact angle to liquid of less than 90° at least at some areas where fluid flows. The surface has a structure that includes a plurality of capillaries with a unique sequential arrangement of capillary components of different elementary types.

The structure can be laser-engraved or formed by other manufacturing methods into a PMMA ((poly)methylmethacrylate) plate or other suitable polymeric substrate. Suitable manufacturing methods include hot embossing, screen printing, 3D printing, micromilling, replica-molding, casting, injection-molding, imprinting, etching, photo-lithography including optical lithography and UV lithography, photopolymerization, two-photon polymerization, or any other suitable method or combination of methods.

In contrast to other microfluidic diode technologies, movable parts like flaps or cylindrical discs are avoided in the structure of the present disclosure. The present disclosure employs conventional bulk materials without a need for chemical treatment or the use of porous substrates. While the present disclosure provides a structure for one-way wicking, the fabricated structures also allow for a complete halting of the liquid front in the reverse direction.

The performance of the structures of the present disclosure eliminate the requirement for interconnection of two or more capillaries as shown in previous attempts such as those in Canadian Patent Application No. CA2875722 A1 to Comanns et al., which describes interconnected capillaries. The single capillaries of the present disclosure suffice for pronounced directional fluid transport. In other aspects of the present disclosure, however, the capillaries can be interconnected if a capillary network is needed. For example, a network of several capillaries can be more fault-tolerant in response to a blockage in one or more capillaries in that alternative paths are provided to circumvent obstacles blocking single capillaries.

The structure described herein provides advantages due to the different design as compared to previous structures. The structure provides for higher volumetric flow (i.e., per a given surface area in contact with the fluid) due in part to the capacity for packing the capillaries more densely, because there is no need for interaction between two capillaries. In other words, there is no oscillating flow between two interacting capillaries. This higher volumetric flow is due to higher transport velocities in part because there is no oscillating flow that tends to limit transport velocity in the forward direction. It is possible that higher net volumetric flow in the forward direction also results from the reduction in backwards flow. In addition, the capillaries of the present disclosure are simpler in design. As a result, the structure is more tolerant of variations in the capillary dimensions, which means that the structure is more tolerant of variations in wetting properties of the applied fluids (e.g., surface tensions and contact angles). The structure is also more tolerant of fabrication errors.

The capillaries of the present structure generally extend in an x-y plane, as shown for example in FIG. 2. The present structure also incorporates a depth profile in a z-direction. As a result, the present structure is designed in such a way that it enhances the performance with regard to directional liquid transport against external pressure such as that induced by gravitational force.

The present structure incorporates an orthogonal depth profile which is designed in such a way that it enhances the performance with regard to directional liquid transport against external pressure such as gravitational pressure and the robustness of directional liquid transport, e.g. against fabrication inaccuracies. Furthermore, this depth profile does not only increase the ability of the structure to halt liquid in backward direction, but does also reduce the overall friction force and increases the capillary driving pressure difference in the deeper regions compared to an overall shallow capillary channel profile which leads to overall higher flow velocities and therefore allows increased volumetric flow rate.

Figure 13:
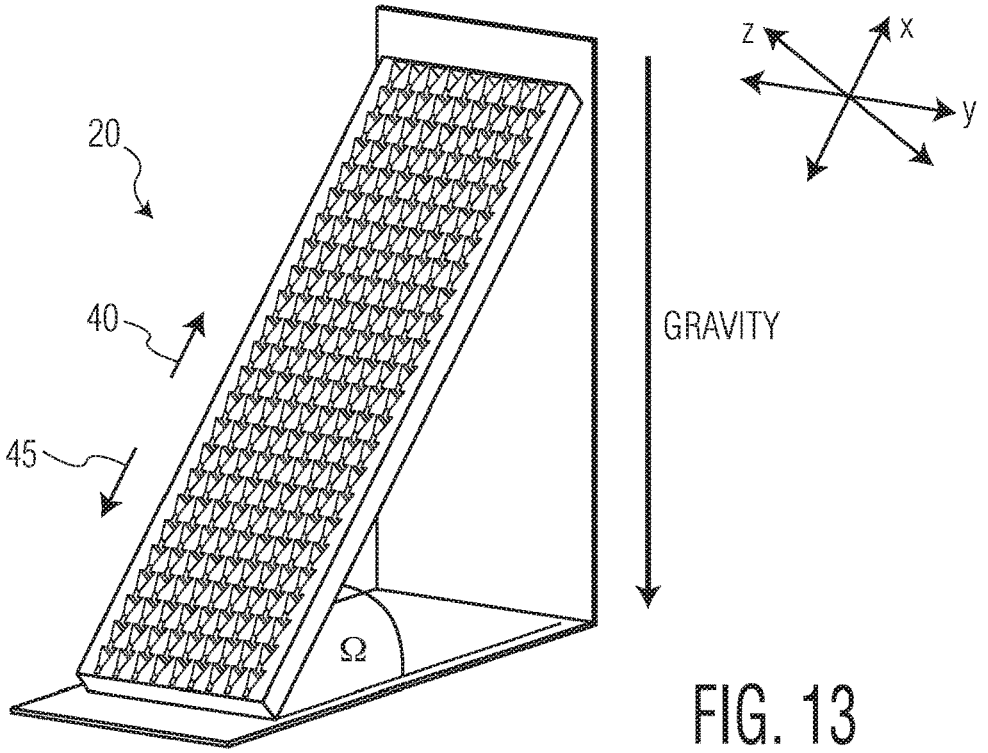
FIG. 13 is a perspective of a surface having a plurality of parallel capillaries, where the surface is set at an angle θ to horizontal to enable testing of the fluid transport properties of the surface.

FIG. 1 schematically illustrates one exemplary general arrangement of a capillary 20 having successive capillary units 25. A capillary 20 includes one or more capillary units 25 arranged linearly, where each capillary unit 25 is in fluid communication with the previous and the succeeding capillary units 25. Two or more capillaries 20 can be arranged in a side-to-side arrangement to provide parallel fluid paths, as illustrated in FIG. 13. The capillaries 20 described herein can be open, partially-closed, or closed in the z-direction, which is the direction perpendicular to the x-y plane of the figures.

Fluid flow through the capillaries 20 is preferentially in the forward direction 40, also known as directional flow.

As illustrated in FIG. 1 and as described in more detail below, a capillary unit 25 includes at least two elementary types of capillary components of defined shape and with a specific depth profile in the orthogonal or z direction. Included are a moderately widening capillary component (a diverging section) and a capillary component with a rapid transition from wide to narrow in the direction of fluid flow 40. The moderate widening of the conic capillary in the diverging section is accompanied by a moderate deepening of the capillary and the rapid transition from wide to narrow at C in the direction of fluid transport 40 takes place in the depth direction as well. The transition section includes abrupt narrowing in both spatial dimensions perpendicular to the direction of liquid transport. The abrupt narrowing can be realized in the form of a ramp or a step making the capillary channel shallower.

A capillary unit 25 can also include a connective section capillary component. The elementary types of capillary components are arranged sequentially in a unique way, and this unique sequential arrangement of elementary types of capillary components leads to passive directional fluid transport in a forward direction 40, even against gravity.

The structure of the present application includes at least a single capillary 20, with or without any junctions or forks that connect to other capillaries. Each capillary 20 includes a potentially-repeating sequence of three specific geometric parameters, the designs of which are dependent on the fluid properties in combination with properties of the substrate. The geometric parameters are an optional connective section A, a diverging section B, and at least one transition point C. The change in depth induces a change in the capillary pressure which is able to compensate for a certain external pressure on the system; this external pressure can be of different origin and can be induced e.g. by a gravitational force or by a hydrostatic pressure.

Figure 2A:
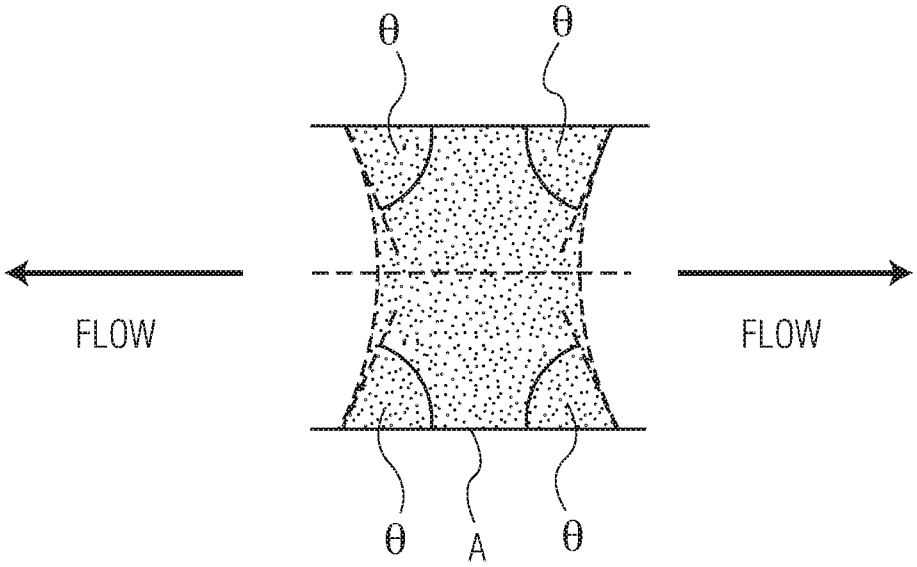
FIG. 2A is a schematic cutaway view of an optional connective section for bidirectional flow, indicated at A in FIG. 1.
Figure 2B:
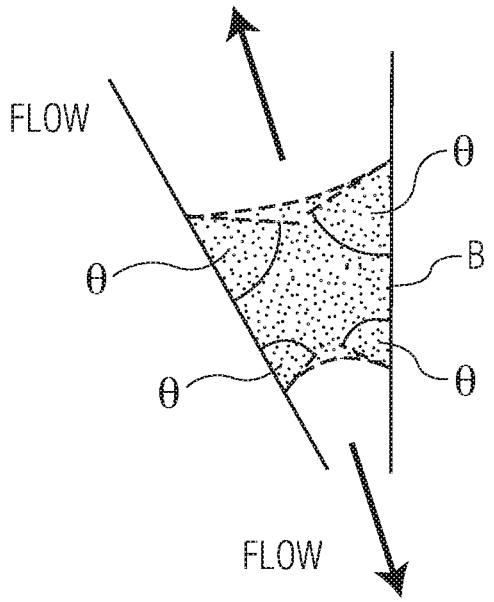
FIG. 2B is a schematic cutaway view of a conic capillary component or diverging section with small angles of slope α for bidirectional flow, indicated at B in FIG. 2.
Figure 2C:
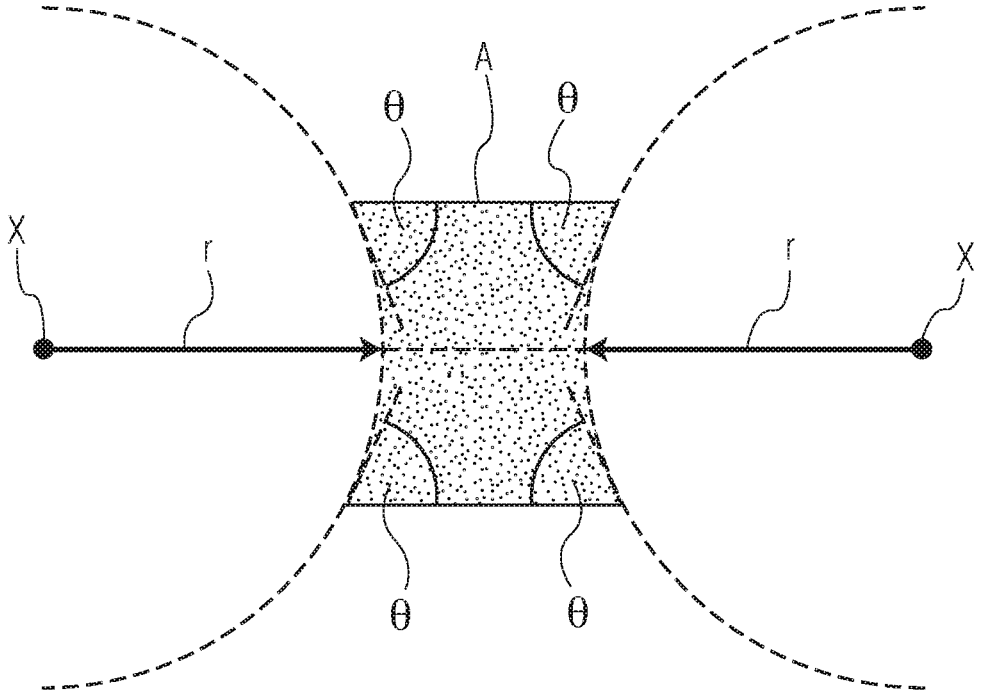
FIG. 2C is a schematic cutaway view of the optional connective section for bidirectional flow, indicated at A in FIG. 1, with a radius of curvature defined.

The definition for concave means "curving in" or "hollowed inward" meaning that an object is bent to some extent towards its center point. In the present application, concave fluids are illustrated in FIGS. 2A and 2B. Concave-shaped liquid fronts, with the capillary force as the driving force behind them, will facilitate liquid movement in all directions indicated in FIGS. 2A and 2B. As illustrated in FIG. 2C, the liquid front has a concave shape with regard to the center point of the liquid, and the radius of curvature r is given by an (imaginary) circular fit through the droplet front. For the situation illustrated in FIG. 2A, the radius of curvature is illustrated in FIG. 2C. The radius of curvature r is the radius of an imaginary sphere that "dents" the droplet inwards on both sides.

Figure 3:
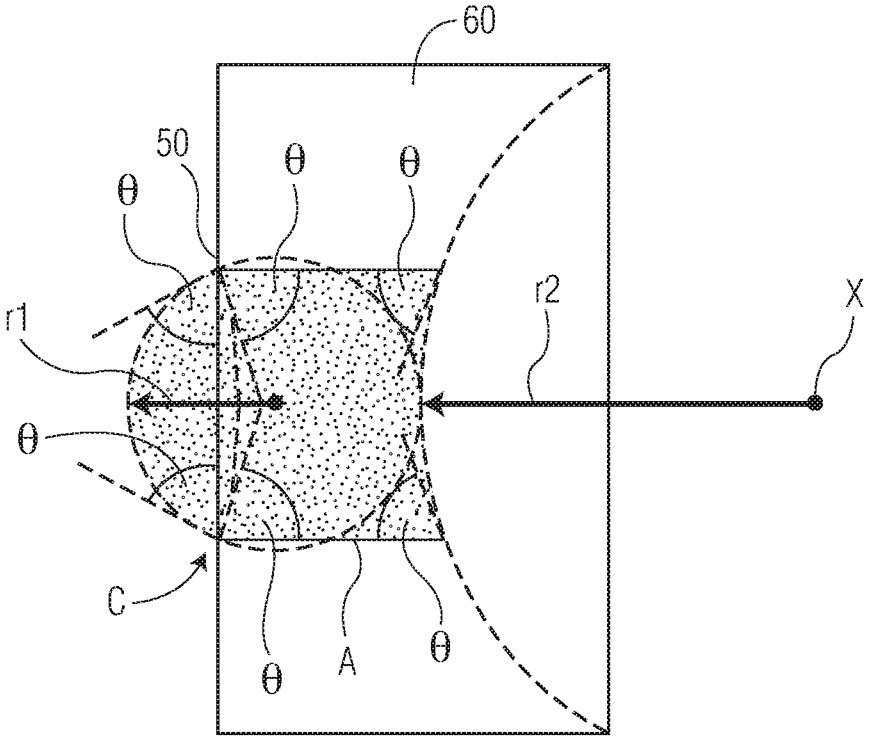
FIG. 3 is a schematic cutaway view of a junction between the conic capillary component of FIG. 2B and the connective capillary component of FIG. 2A with an abrupt narrowing forming a singular transition point resulting in directional flow, indicated at C in FIG. 1, where the radii of curvature r1 and r2 in FIG. 3 are of different lengths.

In contrast, convex means "arched" or "arched outwards." In the present application, convex fluids are illustrated in FIG. 3. The convex radius on the left-hand side hinders the fluid from flowing in the backward direction. In this case, the imaginary sphere originates inside the liquid drop and the radius of curvature is given by r1. The concave-shaped liquid front on the right-hand side has a radius of curvature r2. Because of the asymmetry of the capillary walls, there are two different radii of curvature for one liquid droplet, resulting in an asymmetric capillary driving force for the droplet and facilitating directional flow.

The radius of curvature of the meniscus can be used to determine whether a fluid will flow in the forward direction, or if the fluid will stop in the backward direction. Simple guidelines are that concave equals forward movement, and convex equals stop in backward direction. The liquid front is approximately described by two principal radii of curvature r and r* that are perpendicular to each other and that can be both concave, both convex, or one concave with the other convex. If one radius of curvature is convex and the other one concave, the concave meniscus will increase capillary flow, i.e. the capillary driving pressure difference $\Delta p=\gamma(1/r+1/r^*)$, while the convex one will decrease the flow.

However, the signs associated with the capillary driving pressure difference and the convex and concave radii of curvature need to be defined first. Here, the following notation is used: $\Delta p>0$ for capillary flow, $\Delta p<0$ for halting of the liquid front, $r>0$ for a concave radius of curvature and $r<0$ for a convex radius of curvature, respectively. If the capillary channel is open, the radius of curvature associated with the depth of the capillary channel is always convex and as such reduces the capillary driving pressure difference. The deeper the capillary channel gets compared to the width, the less the radius of curvature associated with the depth of the capillary channel contributes to the overall capillary driving pressure difference.

On a level surface given a constant surface tension solution and a constant volume of solution added, samples with varying depths are able to pin the fluid and block the flow in the channel in the backward direction 45, while channels of a constant depth allow for fluid flow in the backward direction. When the samples are held at an angle $\Omega$ to horizontal, such as the orientation suggested in FIG. 13, including at angles such as $\Omega=45$ and 90 degrees, only the samples with varying depths are able to pin the fluid front to block the flow in the backward direction 45 against the external pressure caused by gravity, while allowing flow vertically against gravity.

Without committing to a theory, it is believed that the effect described herein results at least in part from a depth-induced pressure change at the transition point. This pressure drop can compensate for an external pressure better than can capillaries of constant depth.

The capillaries can be shallower near the transition point C. In the first example, the resulting structure has a typical depth of about 0.7 mm except for the region around the transition point C, where the depth is about 0.4 mm. Adjacent the transition point C, the optional connective section A has a width of 145 μm and is shallower than the conic capillary channel B with a depth of approximately 0.4 mm, yielding a ratio of depth to width of approximately 2.8, denoting this ratio as the aspect ratio of the capillary. It should be noted that the connective section A can be straight and parallel to the x-axis as shown, or the connective section A can be curved, angled, or of any other suitable geometry. In the second example, where the capillary is scaled-up in width by a factor of two compared to the first example, but not in depth. In this example, the connective section A is also shallower with a depth of approximately 0.4 mm, yielding an aspect ratio of approximately 1.4. In both examples, the diverging sections B deepen from the transition point C in the forward direction 40 in a ramp with moderate angles of slope of 20° and 11° for the first and second examples, respectively. There is, however, a more abrupt deepening in the backward direction 45 from the transition point C with angles of slope as large as 70° and 79° for the first and second examples, respectively. In general, some or all of the connective section A can be shallower then the diverging section B. The change in depth allows a liquid front to be pinned at the transition point C effectively without the site of the transition point C being overcome by unwanted flow at the floor and walls of the capillary channel. The depth profile of particular aspects are illustrated in FIGS. 4-12, with top and cross-section views matched. The capillary 20 is shallowest at the transition point C.

Testing has demonstrated that a capillary channel design without variation in the depth of the capillary channels can halt the liquid front in backward direction when a droplet is applied (also against gravity to a certain extent). Capillary channels with depth changes near the transition points provide greater fluid flow than capillary channels with equal depth. Capillary channels with depth changes near the transition points provide greater directionality of liquid transport, especially against external pressure, than capillary channels with equal depth.

EXAMPLES

Example

A connective section is indicated at A in FIG. 1 and is shown schematically in FIG. 2A. The design of the connective section A allows for bi-directional flow. To illustrate an example geometry of the connective section A the following derivation is employed for the capillary driving pressure difference $\Delta p$, which is described by the Young-Laplace equation:

$$\Delta p=\gamma\cdot((-1+\cos(\theta(x)+\beta(x)))/h(x)+2\cos(\theta(x)+\alpha(x))/w(x)).$$

Here $\gamma$ denotes the surface tension of the liquid to the ambient gas, h(x) the depth of the capillary (indicated as $D_1$ and/or $D_2$ in FIGS. 6, 9, and 12), w(x) the width of the capillary (indicated as $W_1$ and/or $W_2$ in FIGS. 5, 8, and 11), $\alpha(x)$ and $\beta(x)$ the angles of slope of the connective capillary's wall in the width y and depth direction z. Here, $\alpha(x)>0$ and $\beta(x)>0$ describe a widening capillary in the width and depth direction, respectively. Here $\theta$ represents the contact angle of the liquid to the solid.

In an example of a straight, connective section of type A with $\alpha$, $\beta=0$ for the straight capillary channel of equal depth ($\Delta p_{eds}$) and $\alpha=0$, $\beta$ (20° and 11° for the small and large arrangements) for the ramped, straight capillary ($\Delta p_{rds}$)

$$\Delta p_{rds}=\gamma\cdot((-1+\cos(\theta+\beta))/h(x)+2\cos\theta/w) \text{ and}$$

$$\Delta p_{eds}=\gamma\cdot((-1+\cos\theta)/h+2\cos\theta/w).$$

The following equations have to be fulfilled for bi-directional liquid transport in the example connective capillaries.

$$\Delta p_{rds}=\gamma\cdot((-1+\cos(\theta+\beta))/h(x)+2\cos\theta/w)>0 \text{ or } \Delta p_{eds}=\gamma\cdot((-1+\cos\theta)/h+2\cos\theta/w)>0,$$

respectively. These formulas can be also expressed as conditions for the aspect ratios of the capillary channels which have to be fulfilled: $a_{rds}(x)=h(x)/w>(1-\cos(\theta+\beta))/(2\cos\theta)>0$ resulting from $\Delta p_{rds}>0$ and $a_{eds}=h/w>(1-\cos\theta)/(2\cos\theta)>0$ resulting from $\Delta p_{eds}>0$.

As a result, the above conditions must be satisfied, and the connective section A needs to be hydrophilic.

A diverging section is indicated at B in FIG. 1 and is shown schematically in FIG. 2B. The generally conic design of the diverging section B with small angles of slope $\alpha$ and $\beta$ also allows for bi-directional flow. It should be noted that $\alpha$ and $\beta$ do not need to be constant along the diverging section. To illustrate an example geometry of the diverging section B the following derivation is employed for the capillary driving pressure difference $\Delta p_{conic}$ that is described by the Young-Laplace equation:

$$\Delta p_{conic,\pm}=\gamma\cdot((-1+\cos(\theta(x)\pm\beta(x)))/h(x)+2\cos(\theta(x)\pm\alpha(x))/w(x)).$$

Here $\Delta p_{conic,+}$ and $\Delta p_{conic,-}$ are the capillary driving pressure differences in the forward direction and the backward direction, respectively. Here $\gamma$ denotes the surface tension of the liquid to the ambient gas, $h_{conic}(x)$ the depth of the capillary, $w_{conic}(x)$ the width of the conic capillary and $\alpha(x)$ and $\beta(x)$ the angles of slope of the conic capillary's wall in the width and the depth direction, respectively. Here $\theta$ represents the contact angle of the liquid to the solid.

The following equations have to be fulfilled for bi-directional liquid transport in the example conic capillary with equal depth ($\Delta p_{conic,ed,\pm}$) and with ramped capillary depth ($\Delta p_{conic,rd,\pm}$)

$$\Delta p_{conic,ed,\pm}=\gamma\cdot((-1+\cos\theta)/h+2\cos(\theta\pm\alpha)/w(x))>0 \text{ and}$$

$$\Delta p_{conic,rd,\pm}=\gamma\cdot((-1+\cos(\theta\pm\beta(x)))/h(x)+2\cos(\theta\pm\alpha)/w(x))>0.$$

Therefore, $2\cos(\theta\pm\alpha)/w(x)>-(-1+\cos\theta)/h$ or $a_{conic,ed,\pm}(x)=h/w(x)>(1-\cos\theta)/(2\cos(\theta\pm\alpha))>0$ in order for the first expression to be >0 and $2\cos(\theta\pm\alpha)/w(x)>-(-1+\cos(\theta\pm\beta(x)))/h(x)$ or $a_{conic,rd,\pm}(x)=h(x)/w(x)>(-1+\cos(\theta\pm\beta(x))/(2\cos(\theta\pm\alpha))>0$ in order for the second expression to be >0.

Additionally, $\cos(\theta+\alpha)$ requires that 0 degrees<$\theta+\alpha$<90 degrees in order to be positive; $\cos(\theta-\alpha)$ requires 0 degrees<$\theta-\alpha$<90 degrees in order to be positive. Similarly, $\cos(\theta+\beta(x))$ requires that 0 degrees<$\theta+\beta(x)$<90 degrees in order to be positive; $\cos(\theta-\beta(x))$ requires 0 degrees<$\theta-\beta(x)$<90 degrees in order to be positive.

Converting to radians, $\alpha<\pi/2-\theta$, $\alpha<\theta$, $\beta(x)<\pi/2-\theta$ and $\beta(x)<\theta$ must be true for the expressions to be >0, if the before assumptions of a contact angle of 0 degrees<$\theta$<90 degrees and angles of slope of 0 degrees<$\alpha$, $\beta(x)$<90 degrees hold. In the fabricated examples p(x) is segmentally constant and denoted as $\beta$ and $\beta'$.

A transition section is indicated at C in FIG. 1. The junction between the generally conic diverging section B and the transition section C results in an abrupt narrowing in the forward direction in the width (in the example with an angle of 90°) and the depth direction y and z forming a singular transition point 50 resulting in directional flow in the forward direction 40. Near the transition point of type C, the connective section A is shallow compared to the diverging section B. In one exemplary capillary arrangement, the depth of the connective section A exactly before the transition point 50 is approximately 400 microns and the depth of the conic capillary exactly before the transition point 50 is approximately 700 microns. Such an arrangement with a difference in the capillary depth of the connective section near the transition point 50 and the deeper conic capillary channel prevents backflow in the backward direction 45 even against external pressure such as pressure from gravitational force.

In other words, the transition of the fluid front from concave to convex at the transition point 50 in the transition section C halts the transport of fluid in the backward direction 45. A capillary driving pressure can compensate for a certain hydrostatic pressure exerted by the gravitational force onto the mass of the liquid slug in the capillary. This means that unidirectional liquid flow even works against gravity for a certain height of capillary rise, where the transition points act as halting points of liquid transport in backward direction 45 even against gravity for a certain volume of liquid.

Without being limited by theory, the following analyses can help clarify the description and is an example of the geometry of capillaries. For the example capillary channel geometries with equal and ramped depths in orthogonal direction, the distances $L_{ed}$ and $L_{rd}$ that the meniscus can travel against gravity in the structure in forward direction, while it is halted in backward direction, can be estimated by the following analytical formulas for the capillary channels of equal and ramped depths:

$\rho\ g\ L_{ed}\sin\Omega=\gamma\cdot((-1+\cos\theta)/h+2\cos(\theta+\alpha)/w(x_f))-\gamma\cdot((-1+\cos\theta)/h-2\sin\theta/w(x_b))$ in the case the liquid stops in the conic capillary part (or straight capillary part with $\alpha=0$) of the capillary channel with constant depth and $\rho\ g\ L_{rd}\sin\Omega=\gamma\cdot((-1+\cos(\theta+\beta(x_f)))/h(x_f)+2\cos(\theta+\alpha)/w(x_f))-\gamma\cdot((-1+\cos(\theta+\beta'))/h(x_b)-2\sin\theta/w(x_b))$ in the case the liquid stops in the conic capillary part (or straight capillary part with $\alpha=0$) of the capillary channel with ramped depth. Here $x_f$ and $x_b$ are the positions of the liquid menisci in the forward direction in the example conic capillary channels (or in the straight connective capillary channel with $\alpha=0$) and in backward direction at the transition point, respectively.

Here, $\rho$, g, and $\Omega$ are the density of the liquid, the gravitational constant and the angle of inclination and an instant widening of the capillary channel with an angle of 90° is assumed. Please note that the traveling distances $L_{ed}$ and $L_{rd}$ can be related to applied volumes of the liquid by calculation of the volumetric capacities $V_{ed}(L_{ed})$ and $V_{rd}(L_{rd})$ versus the penetration distances $L_{ed}$ and $L_{rd}$ of the triangle rows with equal and ramped depths respectively.

Figure 10:
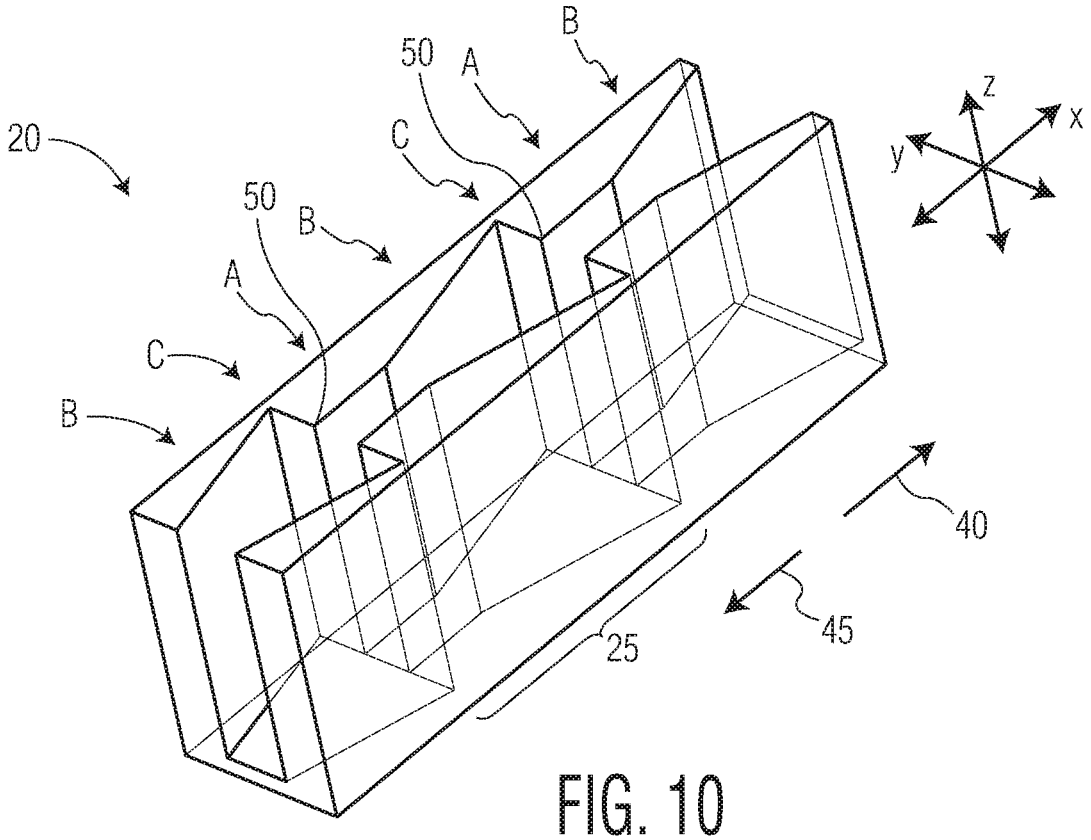
FIG. 10 is a perspective view of still another aspect of a partial capillary of the present disclosure, where the capillary has constant depth.
Figure 11:
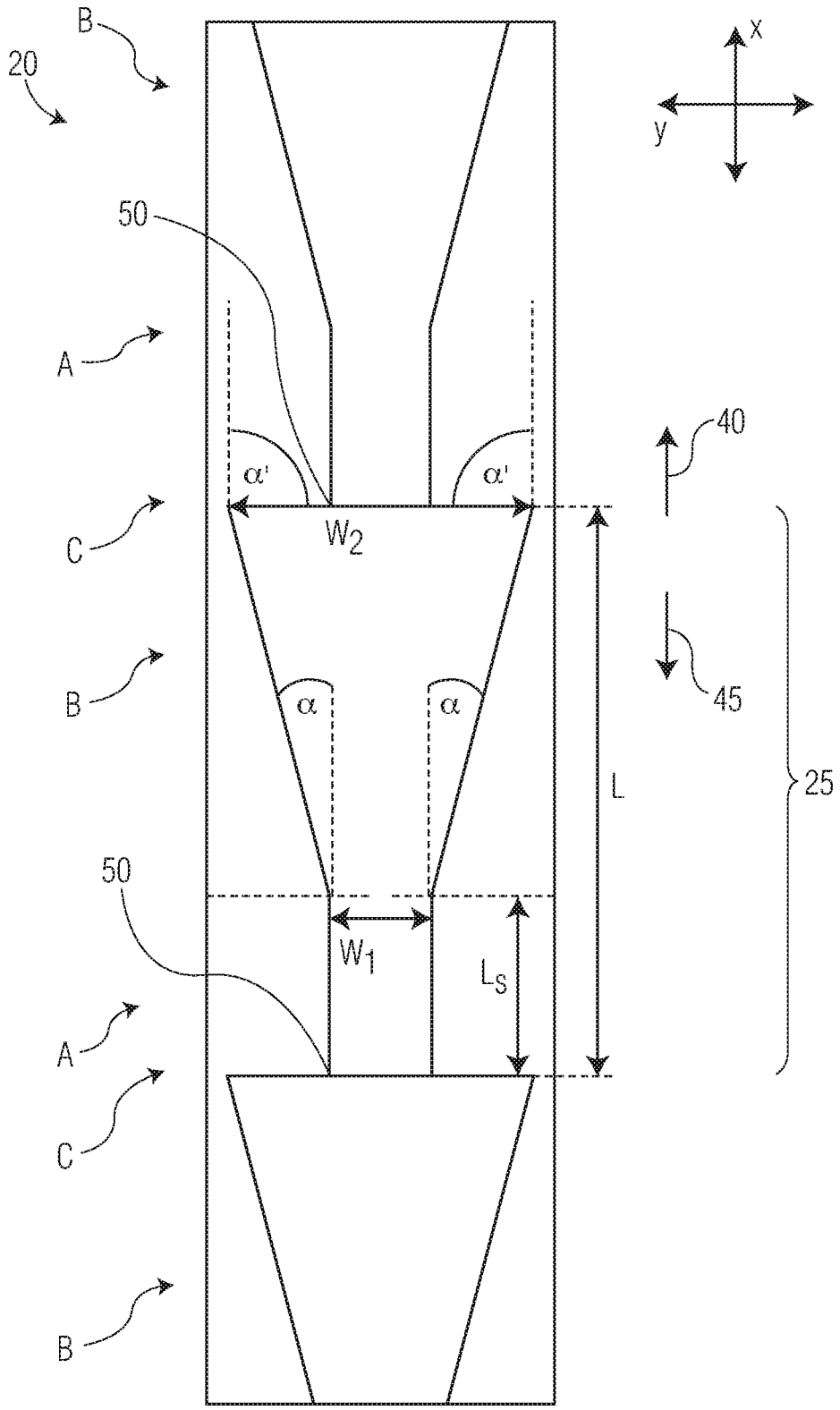
FIG. 11 is a plan view of the partial capillary of FIG. 10, with exemplary dimensions.
Figure 12:
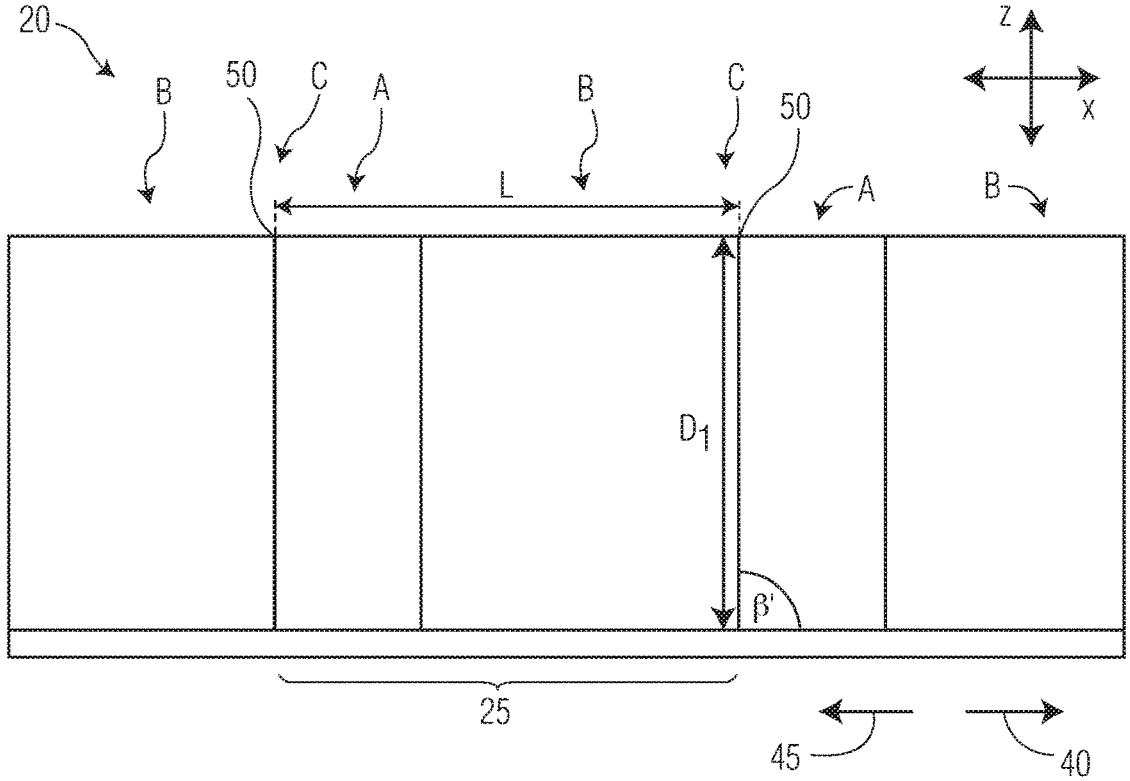
FIG. 12 is an elevation view of the partial capillary of FIG. 10, with exemplary dimensions.

In various examples, samples were prototyped in off-stoichiometry thiol-ene (OSTE) material through an imprinting process. The OSTE samples were fabricated using tools made by micromachining designs into aluminum plates. Multiple rows of each capillary design were repeated in a section of the OSTE material with capillary dimensions and arrangements as shown in FIGS. 4-12. FIGS. 10-12 illustrate the sample design for samples with constant depths, while FIGS. 4-9 illustrate the sample design for samples with varying depths. An aqueous solution of (0.1% by wt.) Pluronic F-38 surfactant from BASF and an aqueous red dye (Ponceau S, 0.25% by wt) was used as the test liquid. This test liquid was found to have a consistent surface tension of 52±4 dynes/cm and a density of about 1 g/mL at standard laboratory conditions. This test liquid had a contact angle on the specific OSTE sample which was 65°±3° (n=20). The samples investigated contained different numbers of channels and contained different total channel volumes, a droplet size of the total channel volume was added to the center of each sample. This "fluid addition" step was repeated while the OSTE samples were in horizontal, 45° inclined, and 90° vertical configurations. Video analysis revealed that in all cases, the samples with varying depths transported the fluid in the forward direction, while stopping the liquid fronts in the opposite direction. In all cases the samples with channels of a constant depth transported the fluid in both the forward and backward direction. The samples with constant depth showed preferential fluid flow in the forward direction, but after the channels were filled to the forward ends, the fluid also flowed in the backward direction. In all cases the test distance was approximately mm and 16 mm in both directions for the small demonstrators and for the large ones, respectively.

Figure 4:
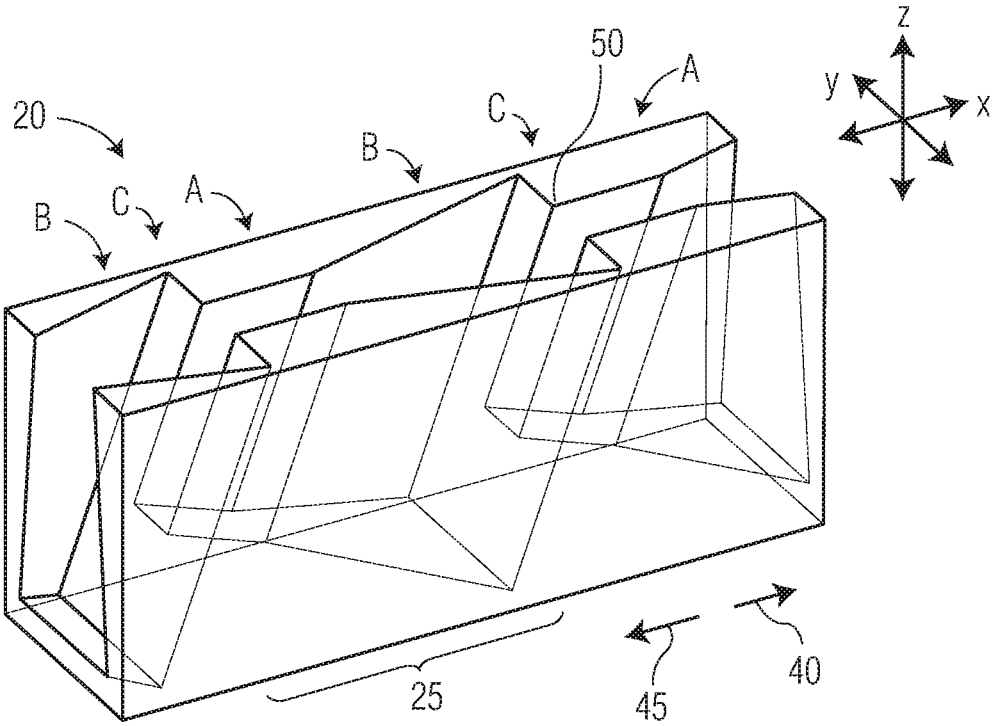
FIG. 4 is a perspective view of one aspect of a partial capillary of the present disclosure, where the capillary has varying depth.
Figure 5:
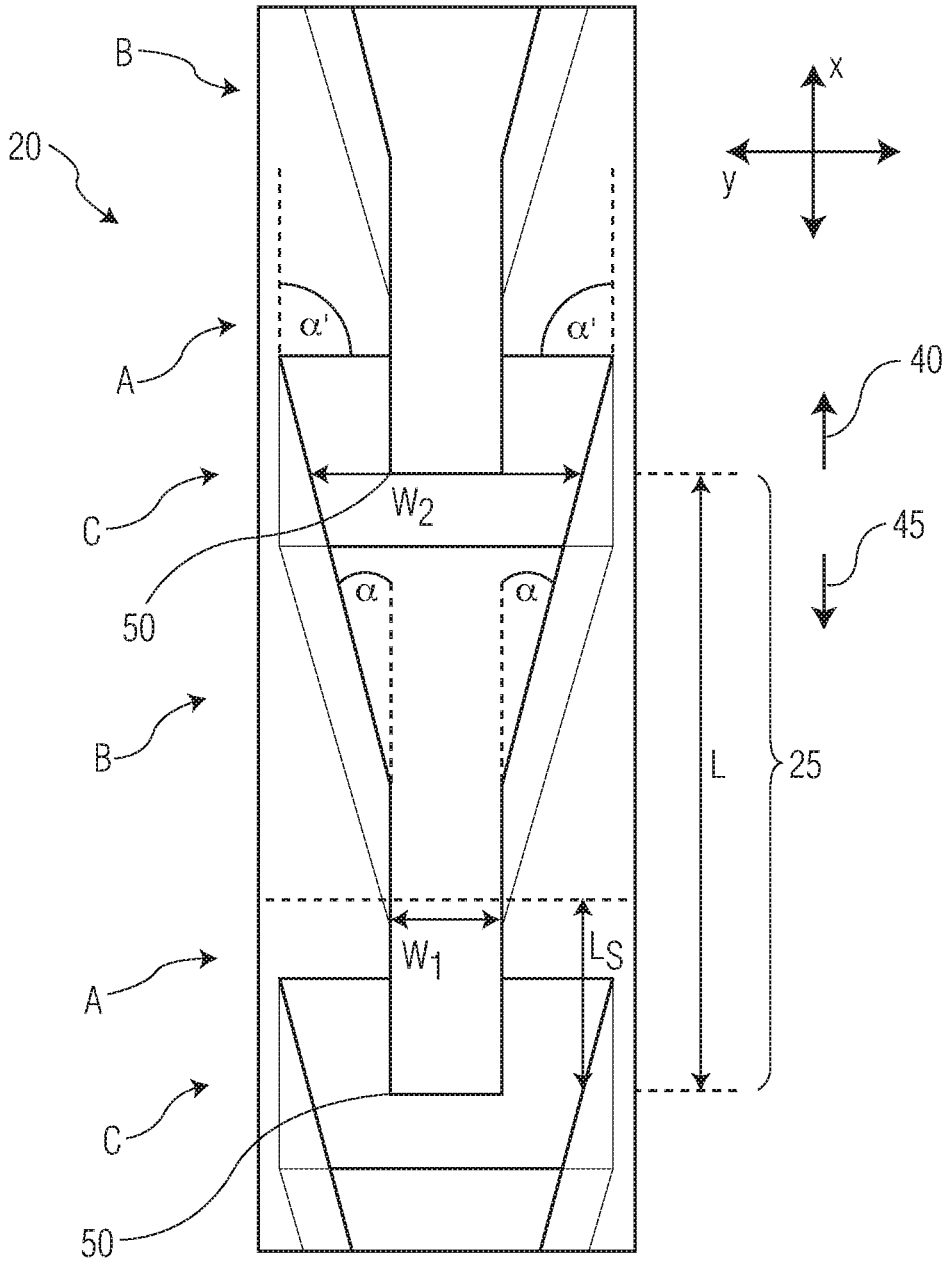
FIG. 5 is a plan view of the partial capillary of FIG. 4, with exemplary dimensions.
Figure 6:
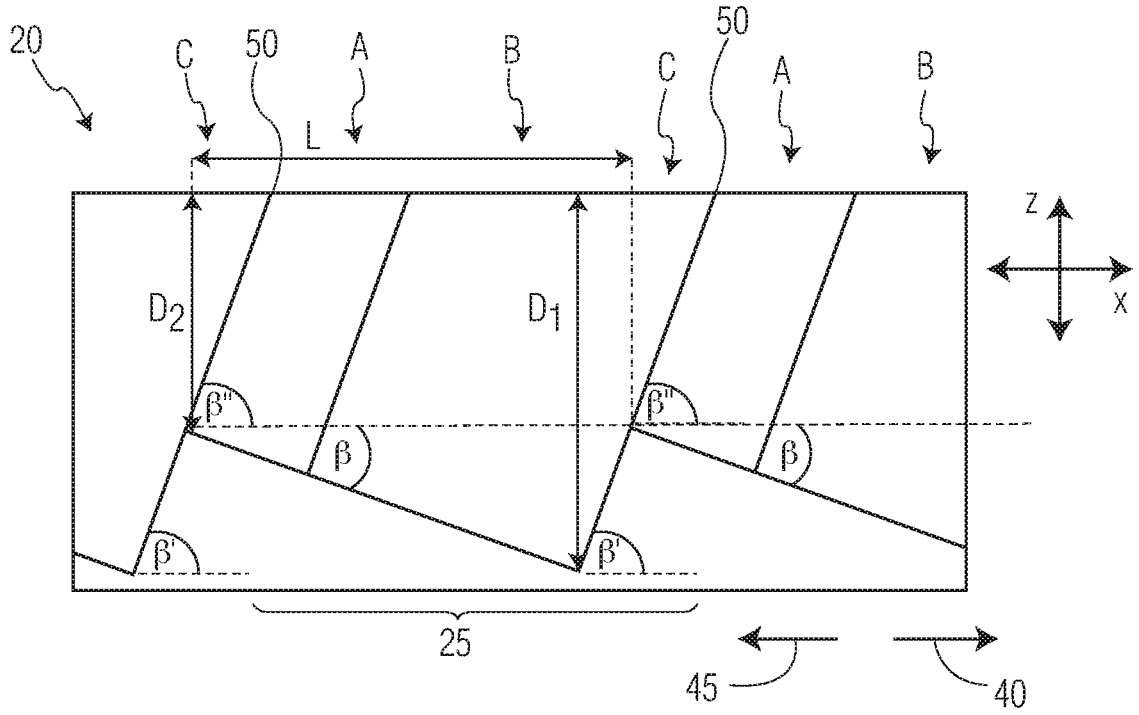
FIG. 6 is an elevation view of the partial capillary of FIG. 4, with exemplary dimensions.

In various aspects of the present disclosure, FIGS. 4-6 illustrate a particular arrangement of capillary units having varying depths. In other words, the depth of the capillary units changes in the direction of forward flow 40. The arrangement shown in FIGS. 4-6 was produced in both large and small sizes, with dimensions and angles as follows (dimensions are in microns and only the absolute values of the angles are given):

| | Large | Small |
|---|---|---|
| L | 1650 | 825 |
| $D_1$ | 700 | 700 |
| $D_2$ | 400 | 400 |

-continued

| | Large | Small |
|---|---|---|
| $W_1$ | 290 | 145 |
| $W_2$ | 880 | 440 |
| $L_s$ | 520 | 260 |
| α | 15° | 24.6° |
| α' | 90° | 90° |
| β | 11° | 20° |
| β' | 79° | 70° |
| β'' | 79° | 70° |

Figure 7:
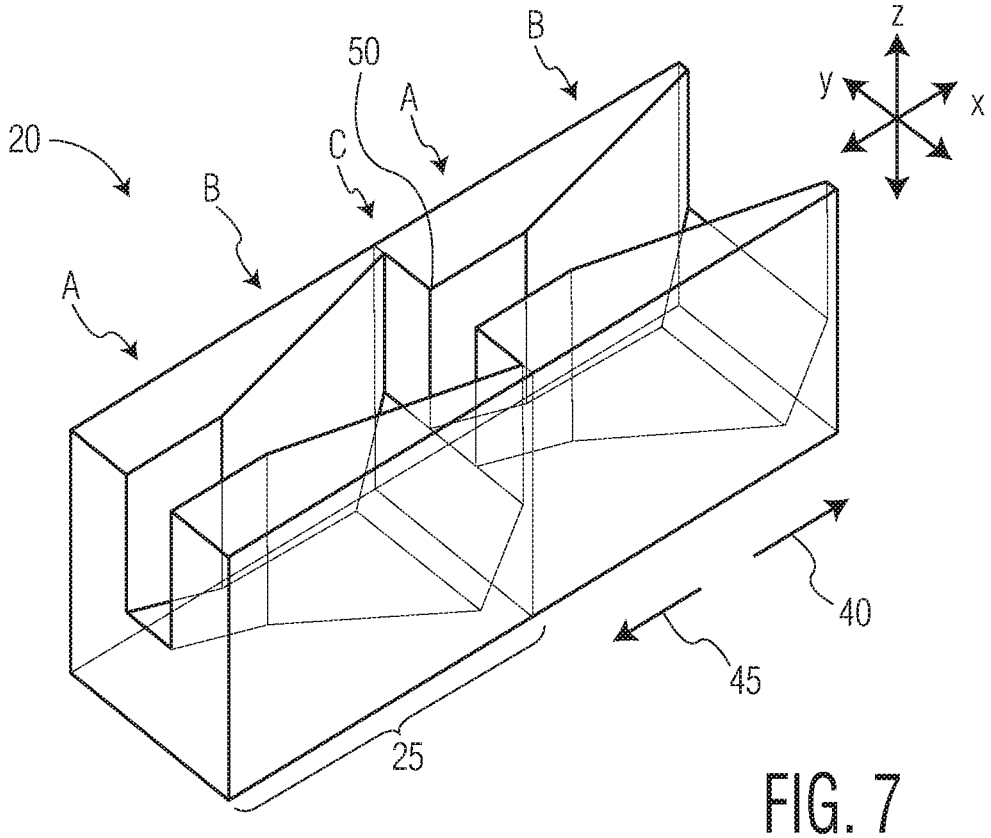
FIG. 7 is a perspective view of another aspect of a partial capillary of the present disclosure, where the capillary has varying depth.
Figure 8:
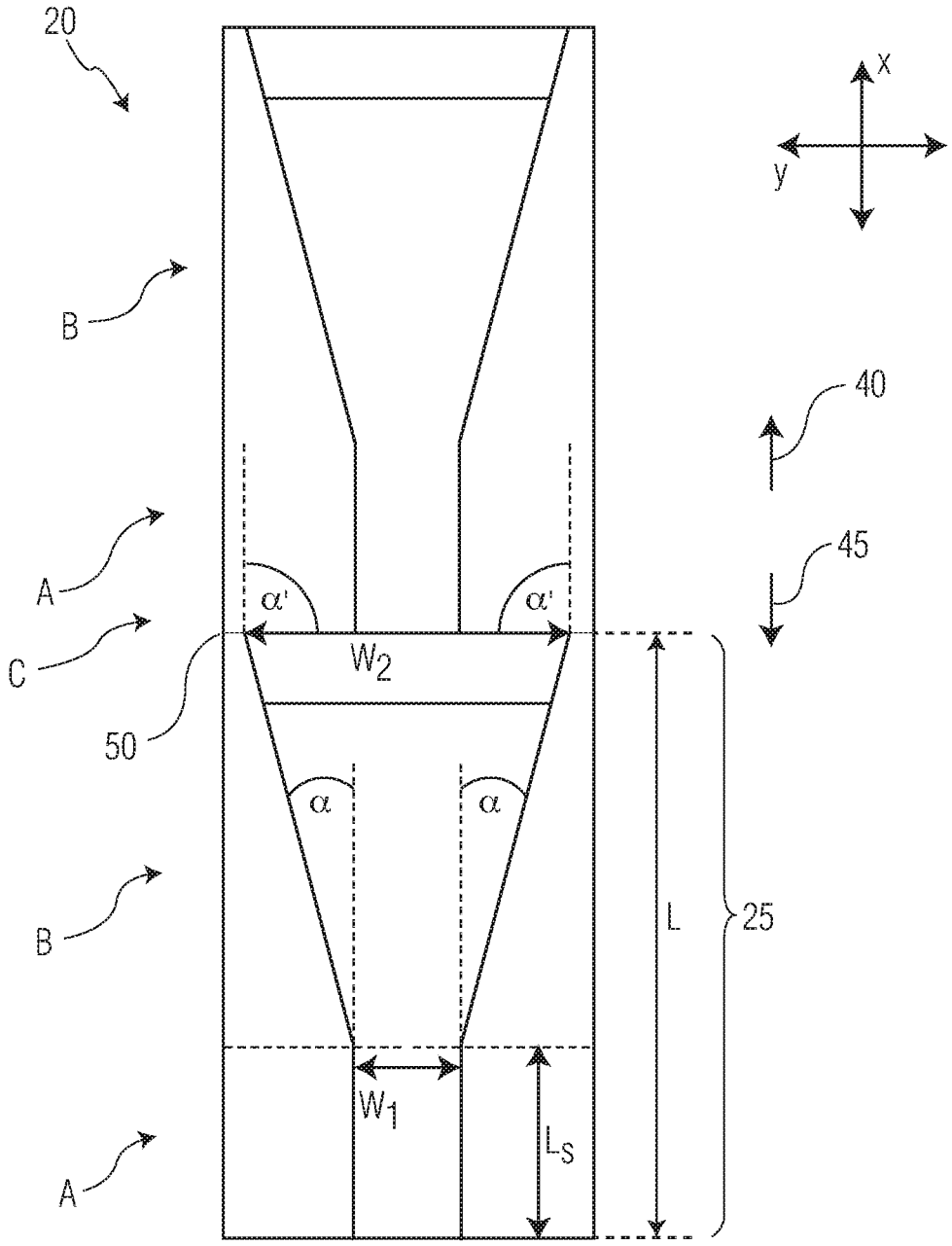
FIG. 8 is a plan view of the partial capillary of FIG. 7, with exemplary dimensions.
Figure 9:
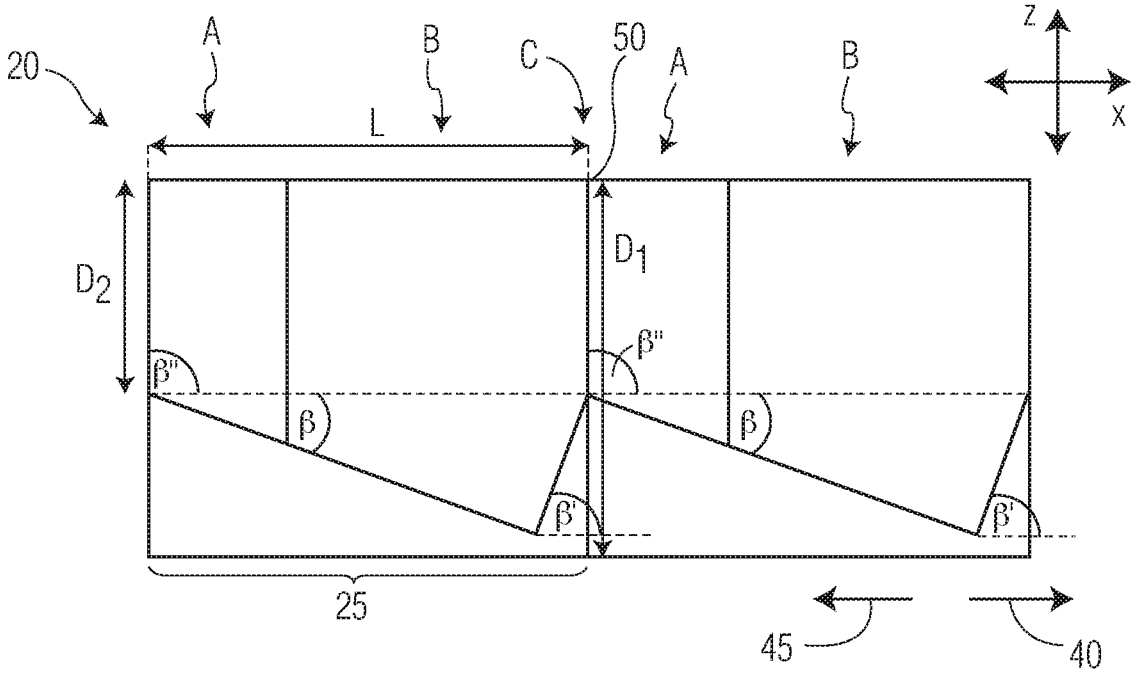
FIG. 9 is an elevation view of the partial capillary of FIG. 7, with exemplary dimensions.

In other aspects of the present disclosure, FIGS. 7-9 illustrate a particular arrangement of capillary units having varying depths. In other words, the depth of the capillary units changes in the direction of forward flow 40. The arrangement shown in FIGS. 7-9 was produced in both large and small sizes, with dimensions and angles as follows (dimensions are in microns and only the absolute values of the angles are given):

| | Large | Small |
|---|---|---|
| L | 1650 | 825 |
| $D_1$ | 700 | 700 |
| $D_2$ | 400 | 400 |
| $W_1$ | 290 | 145 |
| $W_2$ | 880 | 440 |
| $L_s$ | 520 | 260 |
| α | 15° | 24.6° |
| α' | 90° | 90° |
| β | 11° | 20° |
| β' | 79° | 70° |
| β'' | 90° | 90° |

In still other aspects of the present disclosure, FIGS. 10-12 illustrate a particular arrangement of capillary units having flat bottoms. In other words, the capillary units are of constant depth. The arrangement shown in FIGS. 10-12 was produced in both large and small sizes, with dimensions and angles as follows (dimensions are in microns and only the absolute values of the angles are given):

| | Large | Small |
|---|---|---|
| L | 1650 | 825 |
| $D_1$ | 700 | 700 |
| $W_1$ | 290 | 145 |
| $W_2$ | 880 | 440 |
| $L_s$ | 520 | 260 |
| α | 15° | 15° |
| α' | 90° | 90° |
| β' | 90° | 90° |

An alternative method for describing fluid flow is to align the samples with a coordinate plane where the "zero" is in the center where the fluid droplet is placed, while the forward direction is represented by the positive distance and the backward direction is represented by the negative distance. Given the time-frame of the experiments (total observation time typically between ½ min to 5 min), the channels with varying depths resulted in a net positive distance of fluid transport while the samples with constant depth showed a net zero distance, due to the bi-directionality of the fluid flow.

In a first particular aspect, a capillary structure for passive, directional fluid transport includes a capillary having a forward direction and a backward direction extending in an x-y plane and a depth extending in a z-direction, the capillary including first and second capillary units each having a diverging section having a backward end, a forward end, and a width in the y-direction, wherein the width increases from the backward end to the forward end, wherein the backward end of the second capillary unit diverging section is connected to the forward end of the first capillary unit diverging section to form a transition section having a step decrease in width from the forward end of the first capillary unit diverging section to the backward end of the second capillary unit diverging section, and wherein the depth in the transition section is less than the depth in each diverging section.

A second particular aspect includes the first particular aspect, wherein the width increase from the backward end to the forward end in each diverging section is linear A third particular aspect includes the first and/or second aspect, further including a connective section interposed between the forward end of the first capillary unit diverging section and the backward end of the second capillary unit diverging section, wherein the connective section is in fluid communication with each diverging section.

A fourth particular aspect includes one or more of aspects 1-3, wherein the depth in the transition section is less than or equal to the depth in the connective section.

A fifth particular aspect includes one or more of aspects 1-4, wherein the capillary is at least partially open in the z-direction.

A sixth particular aspect includes one or more of aspects 1-5, wherein each diverging section is configured to induce a concave meniscus in the forward direction, and wherein the transition section induces in the backward direction a convex liquid meniscus or a straight liquid meniscus with an infinite radius of curvature.

A seventh particular aspect includes one or more of aspects 1-6, further comprising a plurality of capillaries disposed in parallel to each other.

An eighth particular aspect includes one or more of aspects 1-7, wherein each capillary is without an interconnection to another capillary.

A ninth particular aspect includes one or more of aspects 1-8, wherein the capillary is hydrophilic or lipophilic.

A tenth particular aspect includes one or more of aspects 1-9, wherein the transition section halts fluid transport in the backward direction.

An eleventh particular aspect includes one or more of aspects 1-10, wherein the transition section halts fluid transport in the backward direction against gravitational or hydrostatic pressure.

A twelfth particular aspect includes one or more of aspects 1-11, wherein the depth undergoes a step change from the diverging section to the transition section.

A thirteenth particular aspect includes one or more of aspects 1-12, wherein the depth undergoes a ramped change from the diverging section to the transition section.

In a fourteenth particular aspect, a substrate for directional transport of a fluid having a contact angle θ, the substrate including a capillary structure for passive, directional fluid transport, the capillary structure including a plurality of capillaries each having a forward direction and a backward direction extending in an x-y plane and a depth extending in a z-direction, each capillary including first and second capillary units each having a diverging section having a backward end, a forward end, and a width in the y-direction, wherein the width increases from the backward end to the forward end, wherein the backward end of each second capillary unit diverging section is connected to the forward end of the corresponding first capillary unit diverging section to form a transition section having a step decrease in width from the forward end of the first capillary unit diverging section to the backward end of the second capillary unit diverging section, and wherein the depth in the transition section is less than the depth in each diverging section.

A fifteenth particular aspect includes the fourteenth particular aspect, further including in each capillary a connective section interposed between the forward end of the first capillary unit diverging section and the backward end of the second capillary unit diverging section, wherein the connective section is in fluid communication with each diverging section.

A sixteenth particular aspect includes the fourteenth and/or fifteenth aspect, wherein the depth in the transition section is less than or equal to the depth in the connective section.

In a seventeenth particular aspect, a capillary structure for passive directional transport of a fluid having a contact angle $\theta$ with regard to the capillary structure has a structure including a capillary having a forward direction and a backward direction extending in an x-y plane and a depth extending in a z-direction, the capillary including first and second capillary units each having a diverging section having a backward end, a forward end, and a width in the y-direction, wherein the width increases linearly from the backward end to the forward end, a connective section interposed between the forward end of the first capillary unit diverging section and the backward end of the second capillary unit diverging section, wherein the connective section is in fluid communication with each diverging section, wherein the backward end of each second capillary unit diverging section is connected to the connective section, wherein the forward end of the corresponding first capillary unit diverging section is connected to the connective section to form a transition section having a step decrease in width from the forward end of the first capillary unit diverging section to the connective section, and wherein the depth in the transition section is less than the depth in each diverging section, and wherein the connective section with a width profile w(x) changes depth with an angle profile $\beta(x)$ and has an aspect ratio $\alpha(x)_{connective}=h(x)/w(x)>(1-\cos(\theta+\beta))/(2\cos\theta)>0$, wherein the diverging section diverges from the connective section at an angle $\alpha$ such that $\alpha<\pi/2-\theta$ and $\alpha<\theta$, and wherein the transition section has a depth less than the depth in the diverging section.

An eighteenth particular aspect includes the seventeenth particular aspect, wherein the connective section increases in depth in the forward direction with an angle profile $\beta(x)\geq 0$.

A nineteenth particular aspect includes the seventeenth and/or eighteenth aspect, wherein the connective section increases in depth in the forward direction with a constant angle $\beta\geq 0$.

A twentieth particular aspect includes one or more of aspects 17-19, wherein the transition section halts fluid transport in the backward direction against hydrostatic or gravitational pressure.

These and other modifications and variations to the present disclosure can be practiced by those of ordinary skill in the art, without departing from the spirit and scope of the present disclosure, which is more particularly set forth in the appended claims. In addition, it should be understood that aspects of the various aspects of the present disclosure may be interchanged either in whole or in part. Furthermore, those of ordinary skill in the art will appreciate that the foregoing description is by way of example only, and is not intended to limit the disclosure so further described in such appended claims.

What is claimed:

1. A capillary structure for passive, directional fluid transport, the structure comprising:

a capillary having a forward direction and a backward direction extending in an x-y plane and a depth extending in a z-direction, the capillary comprising first and second capillary units each having a diverging section having a backward end, a forward end, and a width in the y-direction, wherein the width increases from the backward end to the forward end, wherein the backward end of the second capillary unit diverging section is connected to the forward end of the first capillary unit diverging section to form a transition section having a step decrease in width from the forward end of the first capillary unit diverging section to the backward end of the second capillary unit diverging section, and wherein the depth in the transition section is less than the depth in each diverging section.

2. The capillary structure of claim 1, wherein the width linearly increases from the backward end to the forward end in each diverging section.

3. The capillary structure of claim 1, further comprising a connective section interposed between the forward end of the first capillary unit diverging section and the backward end of the second capillary unit diverging section, wherein the connective section is in fluid communication with each diverging section.

4. The capillary structure of claim 3, wherein the depth in the transition section is less than or equal to the depth in the connective section.

5. The capillary structure of claim 1, wherein the capillary is at least partially open in the z-direction.

6. The capillary structure of claim 1, wherein each diverging section is configured to induce a concave meniscus in the forward direction, and wherein the transition section induces in the backward direction a convex liquid meniscus or a straight liquid meniscus with an infinite radius of curvature.

7. The capillary structure of claim 1, further comprising a plurality of capillaries disposed in parallel to each other.

8. The capillary structure of claim 7, wherein each capillary is without an interconnection to another capillary.

9. The capillary structure of claim 1, wherein the capillary is hydrophilic or lipophilic.

10. The capillary structure of claim 1, wherein the transition section halts fluid transport in the backward direction.

11. The capillary structure of claim 1, wherein the transition section halts fluid transport in the backward direction against gravitational or hydrostatic pressure.

12. The capillary structure of claim 1, wherein the depth undergoes a step change from the diverging section to the transition section.

13. The capillary structure of claim 1, wherein the depth undergoes a ramped change from the diverging section to the transition section.

14. A substrate for directional transport of a fluid having a contact angle $\theta$, the substrate comprising a capillary structure for passive, directional fluid transport, the capillary structure comprising a plurality of capillaries each having a forward direction and a backward direction extending in an x-y plane and a depth extending in a z-direction, each capillary comprising first and second capillary units each having a diverging section having a backward end, a forward end, and a width in the y-direction, wherein the width increases from the backward end to the forward end, wherein the backward end of each second capillary unit diverging section is connected to the forward end of the corresponding first capillary unit diverging section to form a transition section having a step decrease in width from the forward end of the first capillary unit diverging section to the backward end of the second capillary unit diverging section, and wherein the depth in the transition section is less than the depth in each diverging section.

15. The substrate of claim 14, further comprising in each capillary a connective section interposed between the forward end of the first capillary unit diverging section and the backward end of the second capillary unit diverging section, wherein the connective section is in fluid communication with each diverging section.

16. The substrate of claim 15, wherein the depth in the transition section is less than or equal to the depth in the connective section.

17. A capillary structure for passive directional transport of a fluid having a contact angle $\theta$ with regard to the capillary structure, the structure comprising:

a capillary having a forward direction and a backward direction extending in an x-y plane and a depth extending in a z-direction, the capillary comprising first and second capillary units each having a diverging section having a backward end, a forward end, and a width in the y-direction, wherein the width increases linearly from the backward end to the forward end, a connective section interposed between the forward end of the first capillary unit diverging section and the backward end of the second capillary unit diverging section, wherein the connective section is in fluid communication with each diverging section wherein the backward end of the second capillary unit diverging section is connected to the connective section, wherein the forward end of the first capillary unit diverging section is connected to the connective section to form a transition section having a step decrease in width from the forward end of the first capillary unit diverging section to the connective section, and wherein the depth in the transition section is less than the depth in each diverging section, and wherein the connective section with a width profile w(x) changes depth h(x) with an angle profile $\beta(x)$ and has an aspect ratio $\alpha(x)_{connective}=h(x)/w(x)>(1-\cos(\theta+\beta))/(2\cos\theta)>0$, wherein the diverging section diverges from the connective section at an angle $\alpha$ such that $\alpha<\pi/2-\theta$ and $\alpha<\theta$, and wherein the transition section has a depth less than the depth in the diverging section.

18. The capillary structure of claim 17, wherein the connective section increases in depth in the forward direction with an angle profile $\beta(x)\leq 0$.

19. The capillary structure of claim 17, wherein the connective section increases in depth in the forward direction with a constant angle $\beta\leq 0$.

20. The capillary structure of claim 17, wherein the transition section halts fluid transport in the backward direction against hydrostatic or gravitational pressure.

* * * * *